US009038825B2

(12) United States Patent
Dincer et al.

(10) Patent No.: US 9,038,825 B2
(45) Date of Patent: May 26, 2015

(54) CONTAINER HAVING TRANSPARENT OPTICAL ELEMENT

(75) Inventors: Ahmet Dincer, Lausanne (CH); Bodo-Werner Lutzig, Chavornay (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 13/821,087

(22) PCT Filed: Sep. 14, 2011

(86) PCT No.: PCT/EP2011/004606

§ 371 (c)(1), (2), (4) Date: May 21, 2013

(87) PCT Pub. No.: WO2012/034686

PCT Pub. Date: Mar. 22, 2012

(65) Prior Publication Data

US 2013/0284621 A1 Oct. 31, 2013

(30) Foreign Application Priority Data

Sep. 16, 2010 (EP) ..... 10251608

(51) Int. Cl.

| | |
|---|---|
| ***A24F 15/12*** | (2006.01) |
| ***B65D 85/10*** | (2006.01) |
| ***B65D 5/42*** | (2006.01) |

(52) U.S. Cl.

CPC ..... *B65D 85/1081* (2013.01); *B65D 5/4212* (2013.01); *B65D 2203/00* (2013.01)

(58) Field of Classification Search

CPC .. B65D 5/4212; B65D 25/20; B65D 85/1081; B65D 2203/00; A24F 15/12; G02B 25/002

USPC ..... 206/242–275, 459.1, 459.5; 359/619–628, 809

See application file for complete search history.

(56) References Cited

U.S. PATENT DOCUMENTS 5,309,279 A * 5/1994 Halstead ..... 359/811
5,525,383 A * 6/1996 Witkowski ..... 206/459.1

(Continued)

FOREIGN PATENT DOCUMENTS

CN 2560593 7/2003
CN 101522536 A 9/2009

(Continued)

OTHER PUBLICATIONS

Office Action issued in China on May 6, 2014, for Application No. 201180044373.3 (14 pages). English translation included.

(Continued)

*Primary Examiner* — Bryon Gehman

(74) *Attorney, Agent, or Firm* — Mueting, Raasch & Gebhardt, P.A.

(57) ABSTRACT

A container (10) for consumer goods comprises a first panel (16) having a pattern (22) applied to an area (20) of the external surface thereof; and a second panel (26) comprising a transparent optical element. The first panel (16) and the second panel (26) are moveable relative to each other between a first position, in which the transparent optical element in the second panel (26) does not overlie the pattern (22) on the first panel (16), and a second position, in which the transparent optical element in the second panel (26) at least partially overlies the pattern (22) on the first panel (16), whereby an altered image of the pattern is visible through the transparent optical element.

15 Claims, 2 Drawing Sheets

(56) References Cited

U.S. PATENT DOCUMENTS

Figure 1:
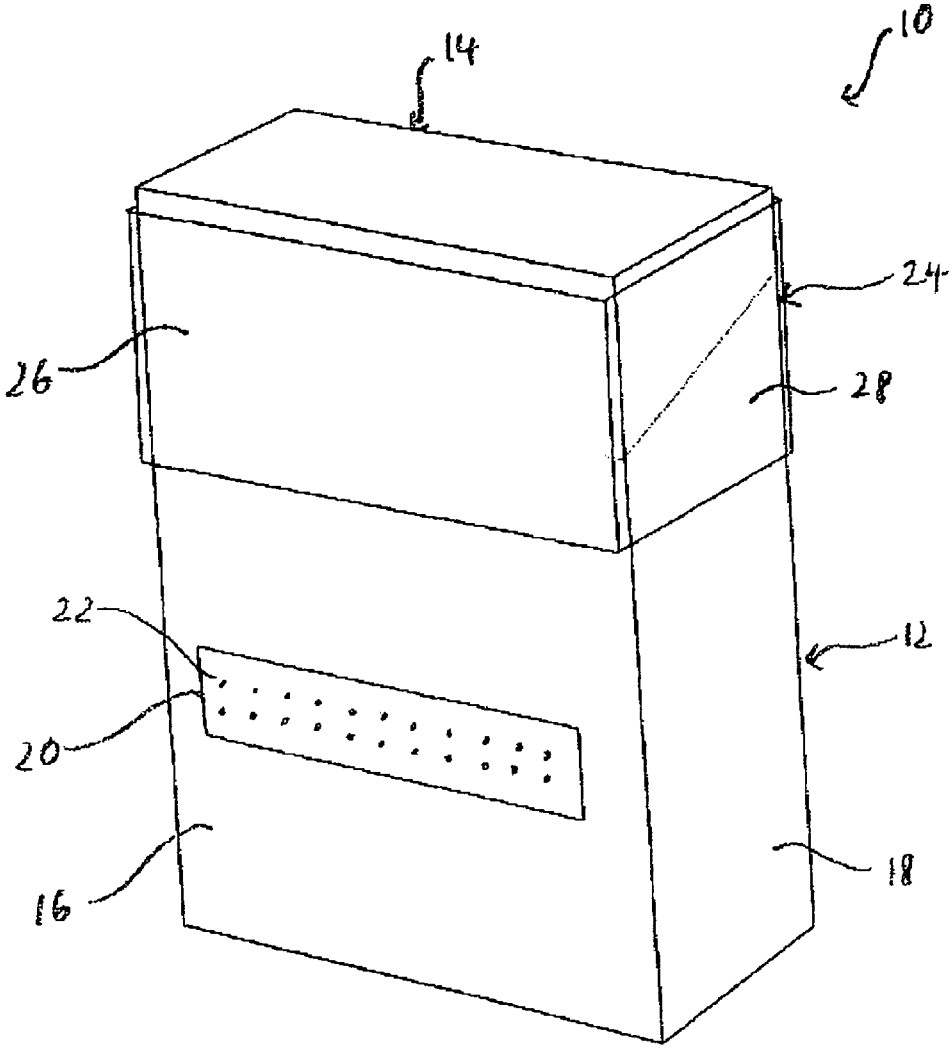

| | | | | |
|---|---|---|---|---|
| 5,588,526 | A * | 12/1996 | Fantone et al. | 206/459.5 |
| 5,769,227 | A * | 6/1998 | Fantone | 206/459.1 |
| 5,782,347 | A * | 7/1998 | Fantone et al. | 206/459.5 |
| 7,796,335 | B2 * | 9/2010 | Karszes et al. | 359/619 |
| 8,240,479 | B2 * | 8/2012 | Loce et al. | 206/769 |
| 2004/0070836 | A1 | 4/2004 | Rosenthal | |
| 2004/0112771 | A1 | 6/2004 | Bailey | |
| 2011/0290795 | A1 | 12/2011 | Loce | |

FOREIGN PATENT DOCUMENTS

| | | | |
|---|---|---|---|
| EP | 0722098 | | 7/1996 |
| EP | 1844921 | | 10/2007 |
| EP | 1 905 613 | A1 | 4/2008 |
| EP | 2 202 164 | A1 | 6/2010 |
| GB | 2 414 332 | A | 11/2005 |
| GB | 2414332 | | 11/2005 |
| JP | H03-004545 | | 1/1991 |
| JP | 3122479 | | 5/2006 |
| JP | 2009-532301 | | 9/2009 |
| JP | 3163321 | | 9/2010 |
| JP | 2011-013412 | | 1/2011 |
| WO | 2003/070602 | | 8/2003 |
| WO | 2004/074123 | | 9/2004 |
| WO | WO 2007/117408 | | 10/2007 |

OTHER PUBLICATIONS

Office Action issued in Japan on Mar. 3, 2014, for Application No. 2013-528552 (6 pages). English translation included.

Korean Notice of Allowance issued on Jan. 20, 2015 Application No. 10-2013-7007417 (4 pages). English translation included.

Eurasian Office Action issued on Nov. 19, 2014, Application No. 201390388/31 (4 pages). English translation included.

* cited by examiner

CONTAINER HAVING TRANSPARENT OPTICAL ELEMENT

This application is a U.S. National Stage Application of International Application No. PCT/EP2011/004606, filed Sep. 14, 2011, which was published in English on Mar. 22, 2012 as International Patent Publication WO 2012/034686 A1. International Application No. PCT/EP2011/004606 also claims priority to European Application No. 10251608.5, filed Sep.16, 2010.

The present invention relates to a novel container for consumer goods. The container finds particular application as a container for elongate smoking articles, such as cigarettes.

It is known to package consumer goods such as, for example, elongate smoking articles in containers formed from folded laminar blanks. For example, elongate smoking articles, such as cigarettes and cigars, are commonly sold in hinge lid packs having a box for housing the smoking articles and a lid connected to the box about a hinge line extending across the back wall of the container. It is also known to package consumer goods in containers comprising an outer shell or sleeve and an inner slide or tray in which the consumer goods are housed and which is slidable within the outer shell.

Graphics and text are typically applied to the exterior of packaging for consumer goods in order to communicate information to the consumer, for example, information about the products and the manufacturer. Graphic designs and patterns are also commonly applied to the surfaces of packaging for consumer goods in order to provide a visually appealing product.

It would be desirable to provide a container for consumer goods that provides novel ways for information or graphics to be visually presented to the consumer.

According to the invention there is provided a container for consumer goods comprising a first panel having a pattern applied to an area of the external surface of the first panel and a second panel comprising a transparent optical element. The first panel and the second panel are moveable relative to each other between a first position, in which the transparent optical element in the second panel does not overlie the pattern on the first panel, and a second position, in which the transparent optical element in the second panel at least partially overlies the pattern on the first panel, whereby an altered image of the pattern is visible through the transparent optical element.

The term "optical element" is used to refer to any optical component that alters the light passing through it in such a way that the image of an object viewed through the optical element is visually altered in some way. For example, the optical element may refract, reflect, diffract, diffuse, filter or polarise at least a portion of the light passing through it, thereby altering the visual representation of the pattern, for example by enlarging, diminishing, contorting, colouring, Fourier-transforming, filtering or otherwise changing the visual representation of the pattern or combinations thereof.

Depending upon the type of optical element incorporated into in the second panel, the image that is visible through the optical element in the second position may be altered in, for example, size, colour, contrast, clarity, depth, visibility or any combination thereof.

The term "light" is used throughout the specification to refer to electromagnetic radiation. Preferably, the electromagnetic radiation is in the visible spectrum, that is, electromagnetic radiation with a wavelength of between about 380 nm and about 780 nm. However, the term "light" is also used in relation to the present invention to refer to electromagnetic radiation in the near invisible spectrum (infrared or ultraviolet) where the optical element alters the light such that an effect in the visible spectrum is created.

By "transparent" is meant that at least a fraction of the light is transmitted through the optical element. The transparency of the optical element is required so that an image of the pattern on the first panel is visible through the optical element in the second position. The transparency preferably ranges between about 5 percent and about 100 percent, more preferably between about 30 percent and about 95 percent.

The term "external surface" is used throughout the specification to indicate a surface of the container that is visible from the outside of the container.

In the first position, the transparent optical element does not coincide with the pattern on the external surface of the first panel, but instead overlies a different part of the container. The pattern may be uncovered and therefore visible to the consumer in its unaltered form. Alternatively, in the first position the pattern may be covered by another wall or panel of the container which will typically be opaque such that the pattern is not visible.

Preferably, the area of the transparent optical element in the second panel is substantially the same size or larger than the area of the first panel within which the pattern has been applied so that in the second position, the pattern is entirely covered by the transparent optical element and the entire pattern is visible.

The pattern on the external surface of the first panel may include any combination of text, logos, images or other graphic designs or patterns. The pattern may be used to provide information to the consumer, or may be a decorative feature of the container, or both. The pattern may cover a portion of the external surface of the first panel, or may cover the entire panel.

Preferably, the optical element comprises one or more lenses. However, other optical components such as prisms or filters may also be suitable, depending upon the desired optical effect. The type of lenses incorporated into the optical element can be adjusted depending upon the desired image type and may include, for example, one or more convex lenses, concave lenses or Fresnel lenses.

In a preferred embodiment of the invention, the optical element comprises a microlens array sheet comprising a transparent base layer and an array of microlenses on the outer surface of the transparent base layer. The term "microlens" refers to a small lens typically having dimensions less than 1 mm and more preferably less than 10 microns. An "array" of microlenses refers to an arrangement of a plurality of microlenses on the base layer. Typically, the microlenses will be arranged in a regular, geometric pattern although irregular arrangements are also possible. In particularly preferred embodiments, the microlens sheet comprises a square or hexagonal array of microlenses on the base layer.

The microlenses may be any type of lens, as set out above. Preferably, the microlens sheet comprises an array of convex microlenses such that in the second position, a magnified image of the pattern on the first panel is visible through the microlens sheet. Certain types of microlens array sheet may additionally alter the perception of depth of the underlying pattern on the first panel, such that the altered image appears as a 3-dimensional image.

In preferred embodiments of the invention in which the optical element comprises a microlens array sheet with convex microlenses, the pattern on the first panel is a micropattern. The term "micropattern" refers to a pattern on a microscopic scale that is typically not visible to the naked human eye. The text or graphics incorporated into the micropattern are therefore only visible through the convex microlenses of the optical element on the second panel and will only become revealed to the consumer when the first and second panels of the container are moved into the second position.

The manufacture of microlens array sheets is described in EP-A-1,905,613. A suitable micolens array sheet for use in the present invention is the HALS® sheet available from Grapac, Japan.

In certain embodiment of the container according to the present invention, an additional pattern may be applied to the inner surface of the transparent optical element so that in the second position, the additional pattern at least partially overlies the pattern on the first panel. In this way, it is possible to superimpose one pattern on top of another in order to generate a unique visual effect. Using certain types of superimposed patterns, it may also be possible to generate a sense of depth.

In containers according to the present invention, the first panel and the second panel are moveable relative to each other between the first position and the second position, as described above. Preferably, the first panel to which the pattern is applied forms at least a part of one of the fixed walls of the container whilst the second panel is mounted on the container for movement relative to the fixed walls. With this arrangement, the consumer is able to move between the first position and the second position by moving the second panel relative to the remainder of the container.

The second panel may be mounted on the outside of the container. Alternatively, the second panel may be initially provided within the container, such that in order to move from the first position to the second position, the second panel must be first removed from the inside of the container before being placed over the first panel. For example, the second panel may be in the form of an insert.

The first panel and the second panel may be slidable relative to each other between the first position and the second position. For example, the second panel may form at least a part of a sliding element mounted around the outside of the container for movement relative thereto. The sliding element may be slidable along the container, or may be slidable around the container.

Alternatively, the first panel and the second panel may be pivotable relative to each other between the first position and the second position. For example, the second panel may be connected to the container such that it is pivotable relative to the first panel about a hinge line extending along one of the walls of the container. Preferably, the hinge line extends along an edge of one of the walls of the container, more preferably an edge of the front wall.

In the first position, the second panel may be positioned on the exterior of the container, overlying a wall of the exterior surface. In this case, preferably retention means are provided in order to retain the second panel in place until the consumer wishes to move it into place over the first panel. Suitable retention means include but are not limited to resealable adhesive, magnets and retention tabs.

In a further alternative, the second panel may not be permanently connected directly to the container but may be provided as a separate insert or onsert which can be removed from the container and moved freely into the second position over the pattern on the first panel.

Containers according to the present invention may be of a known hinge lid construction, comprising a box portion for housing the consumer goods and a lid portion connected to the box portion about a hinge line extending across the back wall of the container. The lid portion is pivotable about the hinge line between a closed position and an open position, in which the consumer goods can be removed from the box portion.

Preferably, the first panel forms a wall of the box portion of the hinge lid container and particularly preferably, the first panel forms the front wall of the box portion such that the pattern is provided on the front face of the hinge lid container. The second panel may be connected to the box portion or the lid portion about a hinge line, or may be incorporated into a sliding element mounted on the container, as described above.

Containers according to the present invention may alternatively be of a 'slide and shell' construction, comprising an inner slide for housing the consumer goods and an outer sleeve mounted around the inner slide for sliding movement relative thereto. Preferably, the first panel forms at least part of a wall of the inner slide. For example, in a particularly preferred embodiment the first panel forms the front wall of the inner slide such that the pattern covers an area on the front face of the container. With this arrangement, the second panel is preferably mounted on the inner slide for movement relative to the first panel.

Preferably, the outer sleeve incorporates the second panel with the transparent optical element, whereby movement of the outer sleeve relative to the inner slide brings about movement of the second panel relative to the pattern on the first panel. The transparent optical element may cover a portion of the second panel, thereby forming a window within the second panel through which the pattern can be viewed. Alternatively, the entire second panel may be formed of the transparent optical element. The other panels forming the walls of the outer sleeve may be formed of the same material as the transparent optical element, or may be formed of a different material such as cardboard, paper or plastic.

Preferably, the internal dimensions of the outer sleeve are substantially the same as the external dimensions of the inner slide, so that inner surfaces of the outer sleeve overlie and abut the outer surfaces of the inner slide.

In certain embodiments of the present invention, the outer sleeve is of substantially the same length as the inner slide, such that in a closed position, the inner slide is enclosed within the outer sleeve. In such embodiments, the pattern on the first panel of the container will be covered by a wall of the outer sleeve in the first position.

In alternative embodiments, the outer sleeve surrounds only a part of the inner slide, such that at least a portion of the inner slide is always exposed. For example, the length of the outer sleeve may be smaller than the length of the inner slide. The outer sleeve may extend around the entire circumference of the inner slide, or may extend only part way around the inner slide.

In the first position, the outer sleeve is positioned with the transparent optical element away from the pattern on the first panel, over a different area of the inner slide. To move the panels towards the second position, the outer sleeve comprising the second panel may be moved relative to the first panel until the second panel at least partially overlies the pattern on the first panel, thereby generating the altered image.

If necessary, containers according to the present invention further may further comprise a friction element to increase the friction between the outer sleeve and the inner slide during the movement of the outer sleeve between the first and second positions. A higher level of friction between the inner slide and outer sleeve advantageously prevents inadvertent movement of the outer sleeve.

The inner slide of container according to the invention may comprise at least one hinge lid which is moveable between a closed position and an open position. In order to access the consumer goods within the inner slide, the consumer must pivot the hinge lid about a hinge line towards the open position. The inner slide may take the form of a standard hinge lid pack, in which the hinge lid is connected to a box portion along a hinge lid extending across the back of the container.

Where the container comprises a hinge lid or lid portion, the second panel may be arranged on the container such that relative movement of the hinge lid between the closed position and the open position brings about the relative movement of the first panel and the second panel between the first position and the second position. Conversely, the second panel may be arranged such that the sliding movement of the second panel relative to the first panel brings about the movement of the hinge lid from the closed position to the open position.

For example, where the second panel is slidable relative to the first panel, the second panel, or an outer sleeve incorporating the second panel, may be connected to the hinge lid such that movement of the hinge lid towards the open position brings about sliding movement of the second panel. Suitable means for connecting the second panel with the hinge lid may include, for example, an arrangement of flaps that engage with each other upon movement of the hinge lid.

The containers according to the invention may be presented to the consumer with the optical element initially in the first position or with the optical element initially in the second position. Where the optical element is initially in the first position, the visual effect is created by moving the optical element into the second position. Where the optical element is initially in the second position, the visual effect may either be already apparent, or the optical effect may become apparent only when the optical element is moved from the second position into the first position. For example, the optical element may overlie and contort the pattern such that the pattern only becomes visible once the optical element is removed. One example of such an optical element is a light filter. In this embodiment the pattern may comprise chromatic inks that are activated once the light filter is moved from the second position to the first position. The chromatic inks may create an effect in the visual spectrum while being activated by invisible light, like for example infrared light or ultraviolet light.

The invention is further directed to a method of altering the visual appearance of a pattern on a container, comprising the steps of providing a container with at least a first panel having a pattern applied to an area of the external surface thereof; providing a second panel comprising a transparent optical element; and correlating the first panel and the second panel such that the transparent optical element in the second panel at least partially overlies the pattern on the first panel, whereby an altered image of the pattern is visible through the transparent optical element. Preferably, the second panel forms part of the container. Preferably, the first panel and the second panel are correlated by moving the first panel and the second panel relative to each other until the second panel at least partially overlies the pattern on the first panel.

The container may be formed from any suitable materials including, but not limited to, cardboard, paperboard, plastic, or combinations thereof. Preferably, the container is formed from one or more folded laminar cardboard blanks and preferably, the cardboard has a weight of between about 100 grams per square metre and about 350 grams per square metre.

The terms "front", "rear", "upper, "lower", "side", "top", "bottom", "left", "right" and other terms used to describe relative positions of the components of containers according to the invention refer to the container in an upright position. When the container in the upright position is open, the consumer goods contained in the inner slide may be removed from the top end of the container. A hinged lid container is in the upright position with the lid at the top end and the hinge on the back.

The terms "left" and "right" are used with reference to side walls of the container when the container is viewed from the front in its upright position.

The term "longitudinal" refers to a direction from bottom to top or vice versa. The term "transverse" refers to a direction perpendicular to the longitudinal direction.

Similarly, the terms "upwards" and "downwards" are used to describe the movement of a sliding element (where present) relative to the housing of containers according to the invention when the container is in an upright position.

Containers according to the invention may be in the shape of a rectangular parallelepiped, with right-angled longitudinal and right-angled transverse edges. Alternatively, the container may comprise one or more rounded longitudinal edges, rounded transverse edges, bevelled longitudinal edges or bevelled transverse edges, or combinations thereof. For example, the container according to the invention may comprise, without limitation:

- One or two longitudinal rounded or bevelled edges on the front wall, and/or one or two longitudinal rounded or bevelled edges on the back wall.
- One or two transverse rounded or bevelled edges on the front wall, and/or one or two transverse rounded or bevelled edges on the back wall.
- One longitudinal rounded edge and one longitudinal bevelled edge on the front wall, and/or one transverse rounded edge and one transverse bevelled edge on the back wall.
- One or two transverse rounded or bevelled edges on the front wall and one or two longitudinal rounded or bevelled edges on the front wall.
- Two longitudinal rounded or bevelled edges on a first side wall or two transverse rounded or bevelled edges on the second side wall.

Where the container comprises one or more rounded edges and is made from one or more laminar blanks, preferably the blanks comprise three, four, five, six or seven scoring lines or creasing lines to form each rounded edge in the assembled container. The scoring lines or creasing lines may be either on the inside of the container or on the outside of the container. Preferably, the scoring lines or creasing lines are spaced from each other by between about 0.3 mm and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the container comprises one or more bevelled edge, preferably the bevelled edge has a width of between about 1 mm and about 10 mm, preferably between about 2 and about 6 mm. Alternatively, the container may comprise a double bevel formed by three parallel creasing or scoring lines that are spaced such that two distinct bevels are formed on the edge of the container.

Where the container comprises a bevelled edge and is made from one or more laminar blanks, the bevel may be formed by two parallel creasing lines or scoring lines in the laminar blank. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the container.

Alternatively, the container may have a non-rectangular transversal cross section, for example polygonal such as triangular or hexagonal, semi-oval or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and thirty smoking articles.

The smoking articles may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Containers according to the present invention may hold smoking articles of the same type or brand, or of different types or brands. In addition, both filterless smoking articles and smoking articles with various filter tips may be contained, as well as smoking articles of differing length (for example, between about 40 mm and about 180 mm), diameter (for example, between about 4 mm and about 9 mm). In addition, the smoking articles may differ in strength of taste, resistance to draw and total particulate matter delivery. Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The length, width and depth of containers according to the invention may be such that in a closed position, the resultant overall dimensions of the container are similar to the dimensions of a typical disposable hinge-lid pack of twenty cigarettes.

Preferably, containers according to the invention have a height of between about 60 mm and about 150 mm, more preferably a height of between about 70 mm and about 125 mm, wherein the height is measured from the bottom wall to the top wall of the container.

Preferably, containers according to the invention have a width of between about 12 mm and about 150 mm, more preferably a width of between about 70 mm and about 125 mm, wherein the width is measured from one side wall to the other side wall of the container.

Preferably, containers according to the invention have a depth of between about 6 mm and about 150 mm, more preferably a depth of between about 12 mm and about 25 mm wherein the depth is measured from the front wall to the back wall of the container.

Preferably, the ratio of the height of the container to the depth of the container is in between about 0.3 to 1 and about 10 to 1, more preferably between about 2 to 1 and about 8 to 1, most preferably between about 3 to 1 and 5 to 1

Preferably, the ratio of the width of the container to the depth of the container is in between about 0.3 to 1 and about 10 to 1, more preferably between about 2 to 1 and about 8 to 1, most preferably between about 2 to 1 and 3 to 1.

In addition to the pattern on the first panel, the interior surfaces or exterior surfaces of containers or both interior and exterior surfaces of containers according to the invention may be printed, embossed, debossed or otherwise embellished with manufacturer or brand logos, trade marks, slogans and other consumer information and indicia.

The consumer goods within the containers according to the invention may be individually wrapped. This has the advantage, that once the container according to the invention is opened and a first consumer good is removed, the remainder of the consumer goods are still wrapped and remain such protected from dust, sunlight or other environmental influences.

Once filled, containers according to the invention may be shrink wrapped or otherwise over wrapped with a transparent polymeric film of, for example, high or low density polyethylene, polypropylene, oriented polypropylene, polyvinylidene chloride, cellulose film, or combinations thereof in a conventional manner. Where containers according to the invention are over wrapped, the over wrapper may include one or more a tear tapes. In addition, the over wrapper may be printed with images, consumer information or other data.

Preferably, hinge lid containers according to the invention are formed from a single laminar blank.

Figure 2:
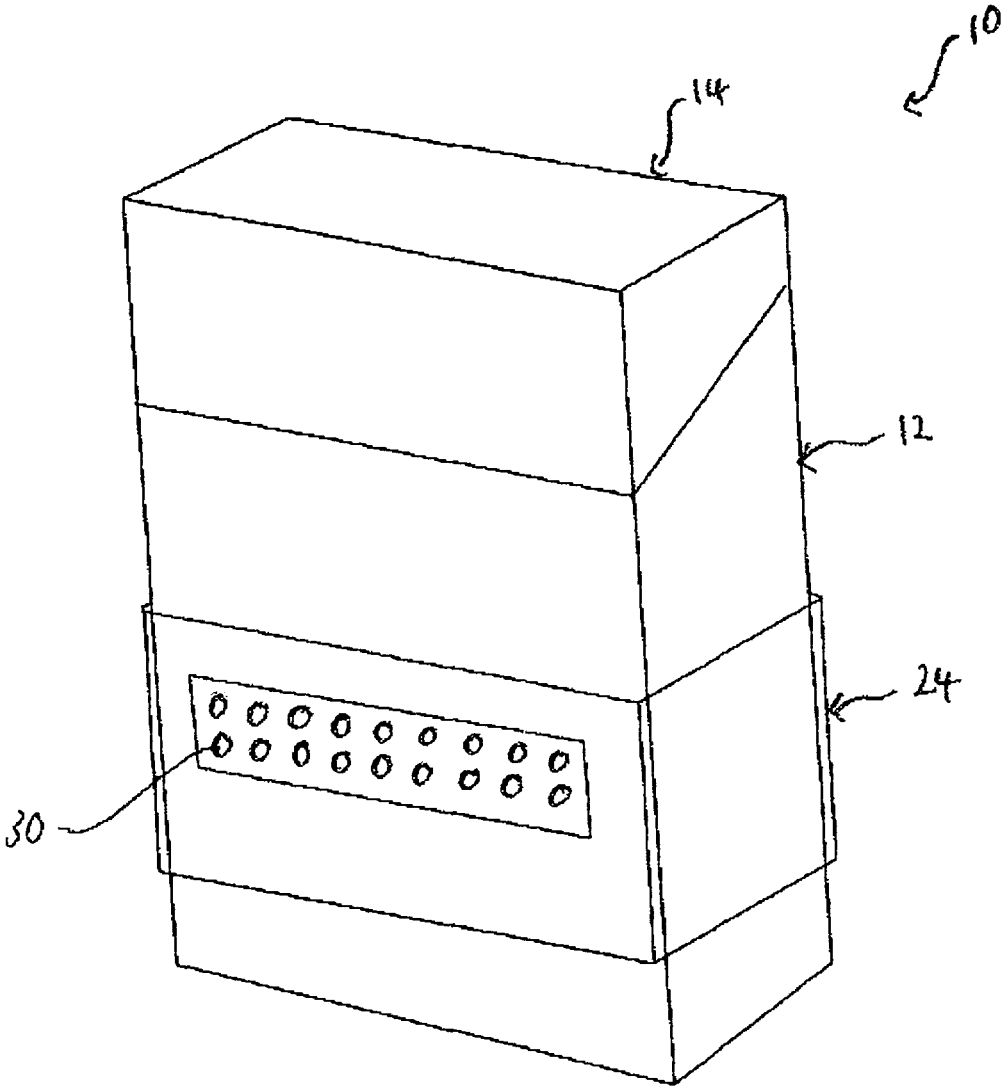

The invention will be further described, by way of example only, with reference to the accompanying drawings in which:

FIG. 1 shows a perspective front view of a container according to the invention, with the first panel and the second panel in the first position; and FIG. 2 shows a perspective view of the container of FIG. 1 with the first panel and the second panel in the second position.

The container 10 shown in FIG. 1 is a rectangular parallelepiped and comprises a box 12 and a lid 14 connected to the box along a hinge line extending substantially horizontally across the back wall of the container. A bundle of smoking articles (not shown) is housed in the box 12 of the container 10.

The box 12 comprises a box front wall 16, a box back wall, a box bottom wall, a box left side wall and a box right side wall 18. The box front wall 16 corresponds to the first panel of the container. The box front wall 16 is provided with a rectangular patterned area 20 approximately in the centre of the front wall. A micropattern 22 (indicated schematically by small circular dots in FIG. 1) has been applied in the patterned area 20 using a known printing technique. The micropattern 22 is not visible to the naked human eye and so the patterned area 20 on the box front wall will not be distinct from the remainder of the box front wall.

An outer sleeve 24 is mounted around the outside of the container 10 for slidable movement therealong. The length of the outer sleeve 24 is approximately one third of the length of the container. The outer sleeve 24 comprises a sleeve front wall 26, a sleeve back wall, a sleeve left side wall and a sleeve right side wall 28. The sleeve front wall 26 corresponds to the second panel of the container. The outer sleeve 24 has opposed open ends at the top and bottom and is formed of a transparent, microlens array sheet material, which comprises a square array of convex microlenses on a transparent base layer.

FIG. 1 shows the container 10 with the first and second panels in the first position, as described above. In this position, the outer sleeve 24 is positioned at the top end of the container, around the lid 14 such that the lid 14 is unable to open. The patterned area 20 on the box front wall 16 is uncovered and the micropattern 22 is not visible to the consumer.

FIG. 2 shows the container 10 with the first and second panels in the second position, as described above. In this position, the outer sleeve 24 has been moved downwards along the container until the sleeve front wall 26 overlies the patterned area 20 on the box front wall 16. The outer sleeve 24 no longer surrounds the lid 14 and the lid may therefore be pivoted towards an open position in order to remove the smoking articles from within the box.

As is shown schematically in FIG. 2, the microlens array sheet material enlarges the micropattern 22 in the patterned area 20 such that an enlarged image 30 of the pattern (schematically indicated by the enlarged circles in FIG. 2) is revealed to the consumer.

The container 10 is assembled from a single laminar blank using known methods and apparatus. The outer sleeve 24 is formed from a piece of microlens array sheet, which is folded into shape and then glued. The outer sleeve 24 may be assembled and subsequently mounted on the assembled container, or may be folded and glued directly around the container.

The invention claimed is:

1. A container for consumer goods comprising:

a first panel having a pattern applied to an area of an external surface of the first panel; and a second panel comprising a transparent optical element, wherein the first panel and the second panel are moveable relative to each other between a first position, in which the transparent optical element in the second panel does not overlie the pattern on the first panel, and a second position, in which the transparent optical element in the second panel at least partially overlies the pattern on the first panel, whereby an altered image of the pattern is visible through the transparent optical element, the container further comprising an inner slide for housing the consumer goods, wherein the first panel forms a wall of the inner slide, and an outer shell including the second panel, wherein the outer shell is mounted all around the inner slide for sliding movement relative thereto, wherein the inner slide comprises one or more hinge lids moveable between a closed position and an open position and wherein the at least one hinge lid may be pivoted between the closed position and the open position when the first and second panels are in the second position.

2. A container according to claim 1 wherein the transparent optical element comprises one or more lenses.

3. A container according to claim 2 wherein the transparent optical element comprises a microlens array sheet comprising a transparent base layer and an array of microlenses on a surface of the transparent base layer.

4. A container according to claim 3 wherein the microlens sheet comprises an array of convex lenses such that in the second position, a magnified image of the pattern on the first panel is visible through the microlens array sheet.

5. A container according to claim 4 wherein the microlens array sheet comprises a hexagonal array of microlenses.

6. A container according to claim 3 wherein the microlens array sheet comprises a hexagonal array of microlenses.

7. A container according to claim 1 wherein the pattern applied to the area of the external surface of the first panel is a micropattern.

8. A container according to claim 1 wherein the first panel and the second panel are slidable relative to each other between the first position and the second position.

9. A container according to claim 1 wherein an additional pattern is applied to the inner surface of the transparent optical element so that in the second position, the additional pattern at least partially overlies the pattern on the first panel.

10. A container according to claim 1 wherein the second panel is arranged such that movement of at least one of the one or more hinged lids between the closed position and the open position brings about the relative movement of the first panel and the second panel between the first position and the second position.

11. A container according to claim 1 comprising one or more smoking articles.

12. An assembly comprising a container according to claim 1 and one or more smoking articles disposed in the container.

13. A container according to claim 1 wherein the inner slide comprises at least one hinge lid moveable between a closed position and an open position.

14. A container according to claim 1 configured to house one or more smoking articles.

15. A pack of smoking articles comprising a container according to claim 1 and one or more smoking articles disposed in the container.

* * * * *